US006554055B1

(12) United States Patent
Leder

(10) Patent No.: US 6,554,055 B1
(45) Date of Patent: Apr. 29, 2003

(54) DEVICE FOR THE CONTINUOUS HORIZONTAL CASTING OF PROFILED MEMBERS, IN PARTICULAR OF METAL STRIPS

(76) Inventor: Roland Leder, Alseggerstrasse 19, A-1180 Wien (AT)

( * ) Notice: Subject to any disclaimer, the term of this patent is extended or adjusted under 35 U.S.C. 154(b) by 0 days.

(21) Appl. No.: 09/622,330

(22) PCT Filed: Feb. 17, 1999

(86) PCT No.: PCT/AT99/00042

§ 371 (c)(1),
(2), (4) Date: Sep. 15, 2000

(87) PCT Pub. No.: WO99/42235

PCT Pub. Date: Aug. 26, 1999

(30) Foreign Application Priority Data

Feb. 18, 1998 (AT) ..... 284/98

(51) Int. Cl.[7] ..... B22D 11/04
(52) U.S. Cl. ..... 164/440
(58) Field of Search ..... 164/440, 490, 164/418, 459, 138, 416, 478

(56) References Cited

U.S. PATENT DOCUMENTS 3,857,437 A * 12/1974 Watts ..... 164/478
4,640,336 A * 2/1987 Arakawa et al. ..... 164/440
4,694,886 A * 9/1987 Sakaguchi ..... 164/416
4,744,406 A * 5/1988 Rostik ..... 164/440
4,802,436 A * 2/1989 Wilson et al. ..... 164/440

FOREIGN PATENT DOCUMENTS

| | | |
|---|---|---|
| DE | 2 412 424 | 10/1974 |
| DE | 31 23 704 | 12/1982 |
| EP | 0 049 239 | 9/1981 |

* cited by examiner

*Primary Examiner*—M. Alexandra Elve
*Assistant Examiner*—Kevin P. Kerns
(74) *Attorney, Agent, or Firm*—Collard & Roe, P.C.

(57) ABSTRACT

An apparatus for the horizontal continuous casting of profiles includes a receptacle for molten metal and an ingot mold connectable to the receptacle by a ramming frame. The ingot mold forms a casting gap having a refractory lining that cannot be wetted by the molten metal. An oscillation drive oscillates the ingot mold in a casting direction and is supported on the receptacle and on the ingot mold. A sliding guide associated with the receptacle and extending in the casting direction supports the ingot mold, and a web is arranged in a transition area between the receptacle and the ingot mold, the web being prestressed with a minimum pressure corresponding to the hydraulic pressure of the molten metal and consisting of refractory fibers that cannot be wetted by the molten metal, to provide a seal against the molten metal.

3 Claims, 3 Drawing Sheets

DEVICE FOR THE CONTINUOUS HORIZONTAL CASTING OF PROFILED MEMBERS, IN PARTICULAR OF METAL STRIPS

BACKGROUND OF THE INVENTION

The invention relates to an apparatus for the horizontal continuous casting of profiles, in particular of metal strips, comprising a receptacle for the molten metal, preferably a holding furnace, an ingot mould connectable to the receptacle via a ramming frame, where the forming casting gap of said ingot mould has a refractory lining that cannot be wetted by the molten metal, and comprising an oscillation drive for the ingot mould in casting direction.

For casting metal strips in a horizontal continuous casing process, the ingot mould defining the forming casting gap is connected to a receptacle for the molten metal via a ramming frame, which receptacle either consists of a holding furnace or can be charged with the molten metal via a holding furnace. With its usually ceramic ramming compound, the ramming frame provides a refractory lining in the transition area between the receptacle and the ingot mould, so that the metallic housing of the ingot mould can detachably be connected to the receptacle in a comparatively easy way. Since advantageous continuous casting conditions require a reciprocating oscillation of the ingot mould in casting direction with respect to the casting strand in the vicinity of the casting gap, it is necessary in these known horizontal continuous casting apparatuses to provide an oscillatory support of the ingot mould together with the receptacle and to connect the, same with an oscillation drive, which not only involves a considerable constructional effort, but also control problems, as in dependence on the respective casting program an excitation of oscillations with predetermined frequencies and amplitudes must be predetermined.

SUMMARY OF THE INVENTION

It is therefore the object underlying the invention to provide an apparatus for the horizontal continuous casting of profiles as described above such that an excitation of oscillations of the ingot mould with predeterminable frequencies and amplitudes can be ensured.

This object is solved by the invention in that the ingot mould is mounted on a sliding guide associated to the receptacle and extending in the casting direction, that the oscillation drive is supported on the one hand on the receptacle and on the other hand on the ingot mould, and that in the transition area between the receptacle and the ingot mould there is provided a web of refractory fibers, which has been prestressed with a minimum pressure corresponding to the hydraulic pressure of the molten metal and consists of refractory fibers that cannot be wetted by the molten metal, to provide a seal against the molten metal.

Due to the sliding guide for the ingot mould, which is associated to the receptable and extends in the casting direction, and the oscillation drive operating between the receptacle and the ingot mould, the mass to be moved in an oscillating way is substantially restricted to the small mass of the ingot mould as compared to the receptacle, which represents an advantageous condition for a precise oscillation control with frequencies and amplitudes that can be predetermined under program control. Such oscillatory support of the ingot mould with respect to the receptacle can, however, only be effected when between the oscillating ingot mould and the stationary receptacle, in which a seal can be provided, which can withstand all mechanical, metallurgical and thermal loads during an operating period adapted to the lifetime of the ingot mould. Such a seal will also include a fibrous web, which is prestressed with a minimum pressure corresponding to the hydraulic pressure of the molten metal, so that this fibrous web cannot be urged away from a sealing surface by the molten metal. This prestressing of the fibrous web thus ensures the close abutment of the web against the sealing surfaces, where the inherent elasticity of the web easily provides for the absorption of the oscillations of the ingot mould when a corresponding dimensioning of the fibrous web is ensured. The fibers of such web should be refractory and must not be wetted by the molten metal. These conditions are advantageously satisfied by carbon fibers, although other fibrous materials may also be used.

The fact that the web fibers cannot be wetted by the molten metal does, however, not exclude a penetration of the molten metal into the pores between the fibers of the web, just as prestressing the fibrous web cannot prevent a penetration of the molten metal. It is therefore recommended to apply a protective gas onto the fibrous web under a minimum pressure which corresponds to the hydraulic pressure of the molten metal, so that the protective gas filling the pores of the fibrous web effectively prevents the molten metal from penetrating into the fibrous web. The additional effort required for applying the protective gas onto the fibrous web can be kept small in view of the fact that it is common practice to also apply such protective gas onto the ramming compound of the ramming frame.

For the arrangement of the fibrous web as a seal against the molten metal, two advantageous solutions are provided. In accordance with the one solution, the ingot mould fixedly connected with the ramming frame can resiliently be braced against the receptacle by clamping the fibrous web between the ramming frame and an ingot mould connecting surface of the receptacle. In this case, the elastic properties of the fibrous web are particularly utilized, because the fibrous web is arranged substantially vertical with respect to the oscillating direction of the ingot mould. The resilient prestressing of the fibrous web is achieved by means of the resilient bracing of the ingot mould against the receptacle, where the oscillation drive must operate against this spring load.

According to the other possible solution, the ingot mould is movably supported with respect to the ramming frame fixedly connected with the receptacle, where in the fibrous web, which surrounds the lining of the casting gap associated to the ingot mould and engaging in the ramming frame, is pressurized by the ramming compound of the ramming frame and urged against the lining of the casting gap. The lining of the casting gap is thus oscillatingly reciprocated inside the fibrous web, which surrounds the same and is retained by the ramming frame, where between the lining and the fibrous web a sliding friction is produced. The prestressing of the fibrous web by means of the ramming compound of the ramming frame in connection with the inherent elasticity of the fibrous web again effects a safe abutment of the fibrous web against the sealing surface, which in this embodiment is formed by the lining of the casting gap.

It can thus be seen that by prestressing the fibrous web the oscillating ingot mould can easily be sealed against the receptacle by utilizing the inherent elasticity of the fibrous web, so that the advantage of an ingot mould oscillating with respect to a stationary receptacle can be utilized for the horizontal continuous casting process.

BRIEF DESCRIPTION OF THE DRAWINGS

In the drawings, the subject-matter of the invention is represented by way of example, wherein.

DETAILED DESCRIPTION OF THE INVENTION

Figure 1:
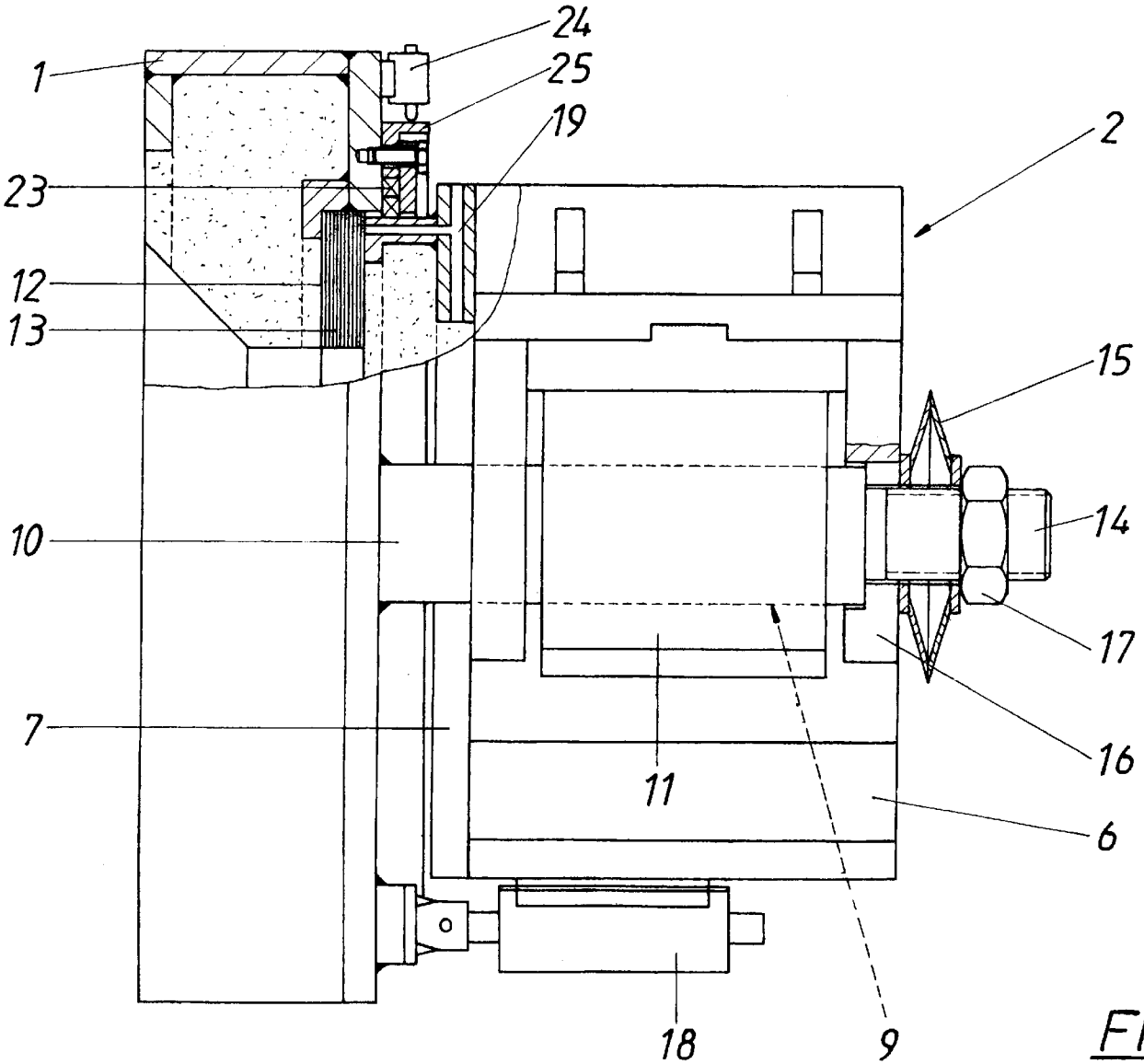
FIG. 1 represents an inventive apparatus for the horizontal continuous casting of a metal strip in a partly elevational side view.
Figure 2:
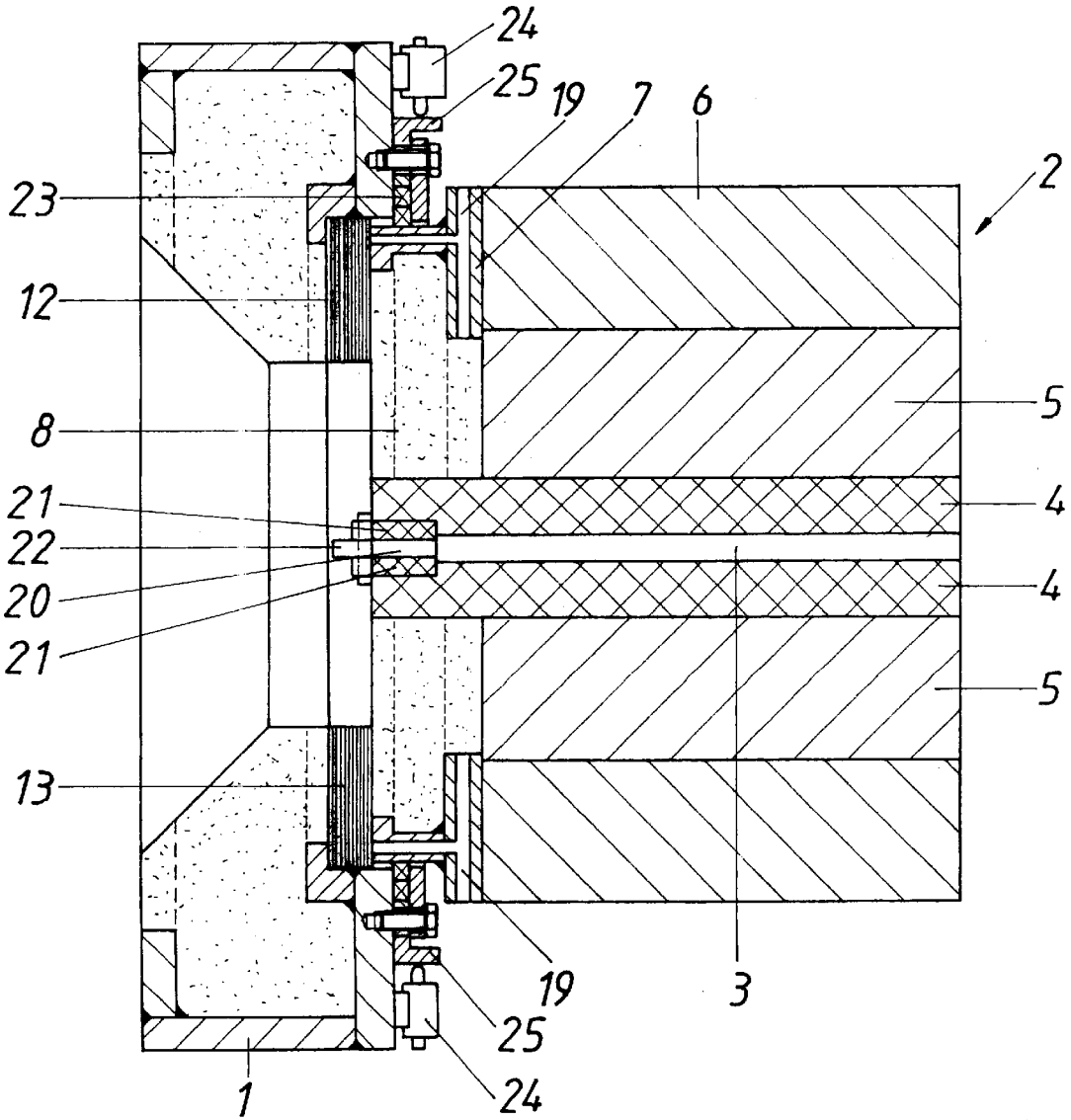
FIG. 2 represents the apparatus shown in FIG. 1 in a vertical section.

The apparatus in accordance with the embodiment represented in FIGS. 1 and 2 comprises a connecting frame 1, which is associated to the receptacle for the molten metal not represented in detail for sake of clarity, for an ingot mould 2 conventionally defining a forming casting gap 3, which has a lining 4 of graphite plates. For cooling the ingot mould, there are used cooling plates 5 made of copper, through which flows a cooling medium, and which are braced together by means of pressure plates of a housing 6. To the housing 6 of the ingot mould 2 a ramming frame 7 is flange-mounted, whose ramming compound 8 forms a refractory lining of the ingot mould 2 with respect to the receptacle. In contrast to conventional constructions of this kind, however, the ramming frame 7 is not screwed to the connecting frame 1 of the receptacle, but together with the ingot mould 2 is supported on a sliding guide 9, which according to FIG. 1 consists of guiding rods 10 attached to the connecting frame 1 on both sides beside the ingot mould 2, on which rods the housing 6 of the ingot mould 2 is movably guided via laterally attached slide bearings 11.

Between the ramming frame 7 and the connecting end face 12 of the connecting frame 1 for the ramming frame 7 there is provided an annular seal made of a web 13 of carbon fibers, which is clamped between the ramming frame 7 and the connecting frame 1. For this purpose, the guiding rods 10 of the sliding guide 9 are provided with a threaded portion 14, on which a cup spring assembly 15 is provided, which is supported on the one hand on a housing lug 16 surrounding the respective guiding rod 10 in a fork-like manner and on the other hand on a tensioning nut 17 on the threaded portion 14. By means of the tensioning nut 17, the ingot mould housing 6 with the ramming frame 7 can thus resiliently be braced down against the connecting frame 1, where the fibrous web 13 is subjected to a prestressing. This prestressing should at least correspond to the hydraulic pressure of the molten metal in the vicinity of the fibrous web 13, so as to prevent the fibrous web 13 from being lifted off the ramming frame 7 and/or the connecting frame 1.

To oscillate the ingot mould 2 with respect to the receptacle in casting direction, an oscillation drive 2 is provided, which is supported on the one hand on the connecting frame 1 and on the other hand on the ingot mould housing 6, as is shown in FIG. 1. By means of this oscillation drive 18, the ingot mould 2 can thus be oscillated, where the oscillation amplitudes are absorbed by the inherent elasticity of the fibrous web 13. As through connecting holes 19 in the ramming frame 7 protective gas can be supplied both to the ramming compound 8 and to the fibrous web 13 under a pressure which at least corresponds to the hydraulic pressure of the molten metal, the penetration of molten metal into the carbon-fiber web 13 or into the ramming compound 8 can easily and effectively be prevented. In addition, flooding the ingot mould 2 with protective gas prevents a supply of oxygen to the graphite lining 4, which excludes the burn-off of the same.

To create particularly favorable casting conditions, the inlet portion 20 of the casting gap 3 is stepped with respect to the subsequent casting gap 3, in that corresponding mouldings 21 are inserted into the casting gap 3. In addition, the inlet portion 20 of the casting gap 3 can be divided across its width into several portions by means of inserts 22, which has an advantageous effect on the course of the solidification front of the metal strip.

To ensure that in a case of failure molten metal cannot escape from the fibrous web 13 between the connecting frame 1 and the ramming frame 7 by overcoming the seal, an additional seal 23 of refractory, graphitized cords is provided, which are mounted on the connecting frame 1 and surround the ramming frame 7. This seal 23 is urged against the ramming frame 7 by means of pressure pads 25 to be activated by means of hydraulic cylinders 24.

Figure 3:
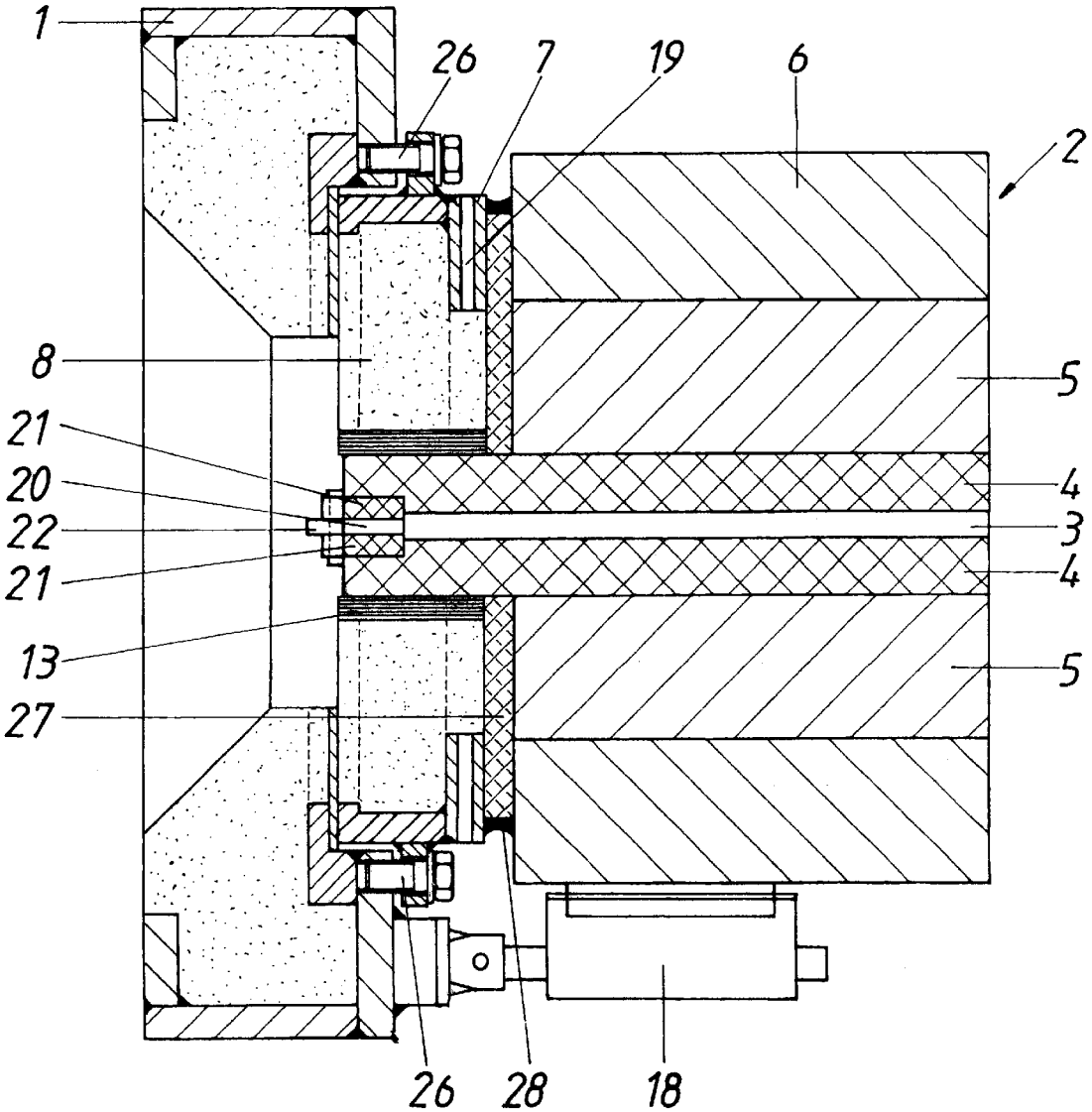
FIG. 3 is a representation of a constructional variant corresponding to FIG. 2.

The apparatus in accordance with the embodiment shown in FIG. 3 substantially only differs from the apparatus shown in FIGS. 1 and 2 in that the ramming frame 7 is rigidly connected with the connecting frame 1 by means of screws 26, whereas the housing 6 of the ingot mould 2 is supported on a sliding guide of the receptacle so as to be movable in casting direction separate from the ramming frame 7. The sliding guide may be designed corresponding to the slitting guide of the embodiment shown in FIG. 1. It is, however, not necessary to brace the ingot mould 2 down with respect to the connecting frame 1 of the receptacle, so that it is not necessary to apply a spring load by means of a cup spring assembly 15. The freely movable support of the ingot mould 2 with respect to the ramming frame 7 first of all leads to the fact that the lining 4 of the casting gap 3, which engages into the ramming frame 7, must be guided so as to be movable with respect to the ramming frame 7 and its ramming compound 8. For this purpose, the seal made of the fibrous web 13 is provided between the lining 4 and the ramming compound 8, which fibrous web surrounds the lining 4 and is prestressed by the ramming compound 8. This pressure load applied by the ramming compound 8 of the ramming frame 7, which leads to a spring deflection of the fibrous web 13 due to its inherent elasticity, on the one hand ensures a close abutment of the fibrous web 13 against the lining 4 which is movable with respect to the fibrous web 13, and on the other hand prevents molten metal from penetrating into the sealing gap between the ramming compound 8 and the lining 4, so that there is obtained an advantageous sealing between the oscillatingly movable ingot mould 2 and the connecting frame 1 with the ramming frame 7 flange-mounted thereto. The remaining gap between the ramming frame 7 and the ingot mould housing 6 may be filled by mineral wool 27 and be sealed at the outside with an elastic seal 28.

What is claimed is:

1. An apparatus for the horizontal continuous casting of profiles comprising a receptacle for molten metal, an ingot mold connectable to the receptacle by a ramming frame for receiving the molten metal under a hydraulic pressure, said ingot mold forming a casting gap having a refractory lining that cannot be wetted by the molten metal, an oscillation drive for oscillating the ingot mold in a casting direction, the oscillation drive being supported on the receptacle and on the ingot mold, a sliding guide associated with the receptacle and extending in the casting direction supporting the ingot mold, and a fibrous web arranged in a transition area between the receptacle and the ingot mold, the web being prestressed with a minimum pressure corresponding to the hydraulic pressure of the molten metal and consisting of refractory fibers that cannot be wetted by the molten metal, to provide a seal against the molten metal.

2. The apparatus as claimed in claim 1, wherein the ingot mold fixedly connected with the ramming frame can resiliently be braced against the receptacle by clamping the fibrous web between the ramming frame and an ingot mold connecting surface of the receptacle.

3. The apparatus as claimed in claim 1, wherein the ingot mold is movably supported with respect to the ramming frame fixedly connected with the receptacle, and the fibrous web pressurized by a ramming compound of the ramming frame transverse to the casting gap surrounds the lining of the casting gap, the lining engaging the ramming frame and being associated with the ingot mold.

* * * * *

UNITED STATES PATENT AND TRADEMARK OFFICE

CERTIFICATE OF CORRECTION

PATENT NO. : 6,554,055 B1
DATED : April 29, 2003
INVENTOR(S) : Leder

It is certified that error appears in the above-identified patent and that said Letters Patent is hereby corrected as shown below:

Title page,
Item [73], Assignee, should read:
-- Thöni Industriebetriebe GmbH, Telfs (AT) --.

Signed and Sealed this

Eighteenth Day of May, 2004

JON W. DUDAS
*Acting Director of the United States Patent and Trademark Office*